US009044762B2

(12) United States Patent
Kopper et al.

(10) Patent No.: US 9,044,762 B2
(45) Date of Patent: Jun. 2, 2015

(54) CENTRIFUGAL LIQUID SEPARATION MACHINE USING PRESSURIZED AIR TO PROMOTE SOLIDS TRANSPORT

(75) Inventors: Michael Kopper, Beach Park, IL (US); Robert Havrin, Lake Bluff, IL (US)

(73) Assignee: Centrisys Corp., Kenosha, WI (US)

( * ) Notice: Subject to any disclaimer, the term of this patent is extended or adjusted under 35 U.S.C. 154(b) by 967 days.

(21) Appl. No.: 13/160,465

(22) Filed: Jun. 14, 2011

(65) Prior Publication Data

US 2011/0306485 A1 Dec. 15, 2011

Related U.S. Application Data

(60) Provisional application No. 61/355,023, filed on Jun. 15, 2010.

(51) Int. Cl.
*B04B 1/20* (2006.01)
*B04B 11/02* (2006.01)

(52) U.S. Cl.
CPC . *B04B 1/20* (2013.01); *B04B 11/02* (2013.01); *B04B 2001/2041* (2013.01); *B04B 2001/2091* (2013.01)

(58) Field of Classification Search
CPC .... B04B 1/20; B04B 11/02; B04B 2001/2041
USPC ..... 494/1–6, 10, 23, 25, 26, 37, 53, 54, 56, 494/67; 210/380.1, 380.3
See application file for complete search history.

(56) References Cited

U.S. PATENT DOCUMENTS

| | | | | |
|---|---|---|---|---|
| 3,302,873 | A * | 2/1967 | Kowata | 494/27 |
| 3,795,361 | A * | 3/1974 | Lee | 494/26 |
| 3,885,734 | A * | 5/1975 | Lee | 494/25 |
| 4,299,352 | A * | 11/1981 | Erickson | 494/27 |
| 4,339,072 | A | 7/1982 | Hiller | |
| 4,790,806 | A * | 12/1988 | High | 494/26 |
| 4,898,571 | A * | 2/1990 | Epper et al. | 494/26 |
| 5,176,616 | A * | 1/1993 | Schlip et al. | 494/37 |
| 5,244,451 | A * | 9/1993 | Retter | 494/37 |
| 5,542,903 | A | 8/1996 | Nishida et al. | |
| 5,779,439 | A | 7/1998 | Dufour | |
| 6,030,332 | A * | 2/2000 | Hensley | 494/53 |
| 8,444,541 | B2 * | 5/2013 | Horbach et al. | 494/10 |
| 8,771,160 | B2 * | 7/2014 | Pomerleau | 494/25 |

(Continued)

FOREIGN PATENT DOCUMENTS

DE 4033012 4/1992

*Primary Examiner* — Charles Cooley
(74) *Attorney, Agent, or Firm* — Brannen Law Office, LLC

(57) ABSTRACT

A screw type centrifugal liquid separation machine having a continuous decanter and using pressurized air to promote solids transport is provided. The machine has an outer bowl and a conveyor, which are coaxial. A back drive assembly is provided to maintain a difference in speed between the bowl and conveyor so that the conveyor has a mechanical sweeping action within a separation region of the machine. Air is introduced into the machine through the back drive assembly, and is injected into the heavy phase discharge path. In one location, the air acts as a turbulence inducer that at least partially re-suspends grits within the heavy phase material. The air is also injected through lift injectors radially spaced about the solids baffle to provide a uniform solid phase driving force. A flow control is also provided for controlling the discharge rate of the heavy phase material through a discharge port.

20 Claims, 4 Drawing Sheets

(56) References Cited

U.S. PATENT DOCUMENTS

2010/0096324 A1 4/2010 Roberts et al.
2011/0009253 A1* 1/2011 Pomerleau ..... 494/23
2011/0306485 A1* 12/2011 Kopper et al. ..... 494/1
2012/0004088 A1* 1/2012 Kopper et al. ..... 494/53

* cited by examiner

CENTRIFUGAL LIQUID SEPARATION MACHINE USING PRESSURIZED AIR TO PROMOTE SOLIDS TRANSPORT

This United States utility patent application claims priority on and the benefit of provisional application 61/355,023 filed Jun. 15, 2010, the entire contents of which are hereby incorporated herein by reference.

BACKGROUND OF THE INVENTION

1. Field of the Invention

The present invention relates to a centrifugal liquid separation machine, and in particular to a screw type centrifugal liquid separation machine having a continuous decanter and using pressurized air to promote solids transport.

2. Description of the Related Art

Centrifugal machines are useful in many types of applications. In one application, wastewater treatment plants, it is desired to achieve a 4% to 6% cake solids discharge. This range of cake solids is required in order for an anaerobic digester to operate efficiently. Falling below this range requires increased digester capacity. Rising above this range typically results in mixing problems due to the thickness of the heavy phase liquids. Even though the principles of the present invention are described with respect to one type of application, it is understood that the invention is in no way limited to this described application.

In the basic form, decanter type centrifugal separation machines have a rotating outer bowl, an internal screw conveyor co-axially aligned with the outer bowl, and a mechanism for maintaining a difference in speed between the rotating outer bowl and the internal screw conveyor to allow for continuous operation of the machine. Rotation of the bowl at elevated speeds results in solid liquid separation action within the separation region of the machine due to elevated levels of gravitational forces within the machine. Materials such as solids and heavier density liquid will thus settle to the outer diameter of the separation region and the lower density liquid will migrate to the inner diameter of the separation region. The separation rate increases with the elevation of gravitational forces resulting from the rotation of the bowl. The screw conveyor has a rotational speed greater or less than the rotational speed of the outer bowl. This difference in speed allows screw conveyor flights to provide a mechanical sweeping action within the separation region.

There have been many centrifuge designs over the years to deal with the challenges of soft more difficult to convey solids. A few of those designs are illustrated in the following US patents.

U.S. Pat. No. 3,795,361 to Lee is titled Centrifuge Apparatus. This patent describes how a decanter centrifuge having a screw conveyor within an imperforate bowl is provided with an annular baffle carried by the screw conveyor. A heavy phase discharge port is taught to be located in a tapered portion of the bowl and is located at a greater radial distance from the rotational axis than the inner surface of the light phase material. The periphery of the baffle is closely spaced from the bowl in order to form a restricted passageway for the underflow of heavy phase material from a separating zone within the cylindrical portion of the bowl to a heavy phase discharge zone within the tapered portion of the bowl. With a conical baffle, incoming feed is directed onto the inwardly facing surface of the baffle and accelerated in order to minimize turbulence in the separating zone. The use of a tapered portion, or a beach, reduces the capacity of the machine, as shallow beach angles required to adequately convey grit or trash requires an undesirably large proportion of bowl length.

U.S. Pat. No. 4,339,072 to Hiller is titled Centrifuge for Separating Solids/Liquids Mixtures. In this invention, a centrifuge drum having an outer jacket is provided with apertures positioned in the jacket. Through the apertures at least a partial discharge of concentrated solids phase occurs thereto. A control device preferably in the form of a disk provides a surface spaced at a small interval from the apertures so as to prevent the flow of solids/liquids through the aperture except when a discontinuity such as a recess or cut-out in the surface occurs so as to allow flow through the aperture. While this patent describes a solution for eliminating a truncated cone by discharging from the outer bowl, its design is not without drawbacks. For example, it is required that all solids pass through very small nozzles. This can result in undesirable amounts of abrasive damage and plugging of the machine.

U.S. Pat. No. 5,542,903 to Nishida et al. is titled Centrifugal Liquid Separating Machine Using Deceleration Vanes. This patent teaches that discharge passages for concentrated and separated liquids are separately formed in shafts of a rotary bowl and a screw conveyor. In an inlet passage of the radial discharge passage leading from the inside of the rotary bowl to the discharge passage in the shaft, an annular space is divided into sectors by a plurality of deceleration vanes which are mounted on the screw conveyor and extend in a radial direction from the axis of the machine. While this patent shows a solution to problems with amorphous trash, is does not address the problems caused by abrasive materials such as grit.

U.S. Pat. No. 4,898,571 to Epper et al. is titled Solid Bowl Centrifuge. This patent illustrates a method and apparatus for separating mixtures of different densities into a lighter phase and a heavier phase including a rotary truncated cone shaped drum providing a cylindrical settling sump at the outer wall, a displacement member rotatably located within the drum forming a settling sump between the displacement member and the drum wall, a discharge element for lighter phase material spaced radially inwardly from the settling sump, a discharge conductor for heavier phase material leading from the settling sump at the deepest location at the outer circumference of the drum, and a compressed air conduit connected to the discharge for heavier phase material aiding in the removal thereof, and vanes on the displacement member aiding in movement of the material through the drum. The lighter and heavier phase materials both exit the apparatus at the same end of the apparatus. Yet, both the bowl and back drive are shown to be on the save end as the feed introduction point, and conventional back drive systems of that era did not allow for the center axis flow of process materials.

U.S. Pat. No. 5,176,616 to Schlip et al. is titled Method and Apparatus for the After-Treatment of the Thick Material Discharge Region of a Solid Bowl Worm Centrifuge. This patent teaches the use of a centrifugal solid bowl worm separator having an outer cylindrical drum and an inner rotatable worm with helical flights on the outer surface with the drum arranged to receive a material to be separated in light and heavy fractions or phases and the mechanism provides for a method of injecting and mixing a fluidizing substance into the heavy fraction material within the drum before it leaves the drum to mix with the heavy fraction within the drum. The fluidizing substance lowers the density of the heavy fraction to enable its discharge by the worm flights. The hydraulic pressure of the liquid helps push the heavy fraction out of the separator which prevents a reverse flow and intermixing of the heavy fraction with the liquid fraction. However, it is apparent that this patent does not illustrate a suitable structure for adequately mixing air with sludge, and therefore the design can be improved upon.

U.S. Pat. No. 5,244,451 to Retter is titled Method for Operating a Worm Centrifuge Having a Pressurized Gas Introduction. This patent shows a method for operating and improving the throughput and efficiency of a worm centrifuge by introducing, at a controlled frequency, successive pressure surges into the concentrated sludge fraction within the bowl separator preceding the solids discharge opening whereby the pulse frequency and the level of pressure are controllable and can be controlled as a function of the sludge fraction throughput through the separator. This patent shows the use of a pulsating airflow as a means to overcome air distribution short circuiting in the cake discharge path. In this regard, it does not show a continuous induction of air.

U.S. Pat. No. 4,790,806 to High is titled Decanter Centrifuge Incorporating Airlift Device. This patent shows a decanter centrifuge which includes an annular bowl, a hollow tube on the axis of the bowl, and means for discharging from the bowl a first phase of an input sludge, the centrifuge being characterized by a fluid-activated airlift device which includes a discharge line radially supported from the hollow tube, and a fluid supply line for conveying fluid from within the hollow tube to an outer end portion of the discharge line to effect removal from the bowl through said line of another phase of the sludge. The air in this invention is taught to be conducted by pipe line through the hub. Coarse particles of the heavy phase material are prevented from entering the airlift device by virtue of a narrow clearance between the sludge inlet to the airlift device and the inside surface of the wall of the bowl. If oversized particles are removed from (or absent in) the feed slurry all of the sedimented solids can be discharged by means of the airlift device, and the conical-beach portion of the decanter bowl is not required. Implicit in this teaching is the limitation that the beach is required when oversized particles are not removed from the feed slurry. Also problematic is that success of localizing the article transport was short circuiting the hydrodynamic effects in the cylindrical portions of the unit.

None of these patents show a design with an air delivery system entering through a back drive system.

None of these patents show a design with continuous axial air inlet behind a solids baffle in a screw type centrifugal system.

None of these patents show a design with uniform spacing of fine air particle inlets across a radial cross section of the flow pathway.

None of these patents show a design with turbulence induction to at least partially re-suspend grit in discharge flow path.

None of these patents show a continuous process control operated by measuring the properties of the heavy phase discharge stream with a sensor, and accordingly adjusting the continuous air supplied to achieve a desired heavy phase discharge consistency.

Thus, there exists a need for a centrifugal liquid separation machine that solves these and other problems.

SUMMARY OF THE INVENTION

The present invention relates to a centrifugal liquid separation machine, and in particular to a screw type centrifugal liquid separation machine having a continuous decanter and using pressurized air to promote solids transport. According to one embodiment of the present invention, the machine has an outer bowl and a conveyor. The bowl and conveyor are coaxial, and a back drive assembly causes these components to rotate at different speeds to allow the conveyor to mechanically sweep heavy phase materials within a separation region of the machine. Air is introduced into the machine through the back drive assembly, and is injected into the heavy phase discharge path. At a first location, the air acts as a turbulence inducer that at least partially re-suspends grits within the heavy phase material. The air is also injected at a second location through lift injectors radially spaced about the solids baffle to provide a uniform solid phase driving force. A flow control is also provided for controlling the discharge rate of the heavy phase material through a discharge port.

Air injected inside a centrifugal decanter has several properties that can be used to affect improved performance on centrifugal separators. Useful properties derived from air pressure include bubble size and density which, along with gravitational force and kinematic viscosity determine how rapid the air percolates across a phase boundary. Air particles under the surface of the pool are also subject to the gravitational and kinetic effects suggested by Stokes Law defined herein as follows:

$$V_s = d^2(p_p - p_1)/18\,\mu \times G, \text{ where:}$$

$V_s$=particle settling velocity
d=particle diameter
$p_p$=particle density
$p_1$=liquid density
G=gravitational acceleration
μ=viscosity of liquid Yet, Stokes Law does not fully describe the physics of the operation of the present invention. First, as an air bubble is a compressible gas, the bubble will increase in size as the air particle gets closer to the pool surface. This change in volume can be approximated by the ideal gas law where $$Vol_f = Vol_i \times \frac{P_i}{P_f}$$

and the pressure is the hydrostatic head of water at a particular radii amplified by the force of gravity Second, as such particles obey buoyancy laws and move in a radial inward manner, there is a de-acceleration in the kinetic energy and an angular component is added to the direction the air particle flows due to higher density fluid de-accelerating into the space occupied by the air bubble.

These effects are advantageously harnessed by the present invention. In this regard, air injected inside the decanter and underneath the pool level regulates the differential pressure driving force and therefore the flow rate across a structural baffle or solids baffle. There is no flow across the baffle when the hydraulic forces are balanced, as both sides of the baffle are in equilibrium. This phenomenon is defined by the following equation:

$$\rho_a G_a h_a = \rho_b G_b h_b, \text{ where } a \text{ and } b \text{ are different sides of a barrier and}$$

h=the height of fluid
ρ=density of fluid

Changing the liquid level on one side of the baffle results in a flow rate as the system attempts to come to equilibrium by adjusting to the different height. Air injection has the same effect by selectively changing the density of the fluid on one side of the baffle. Further, the amount of air used by the present invention is proportional to the amount of volume that flow across the structural baffle as the density of air is near zero. Therefore, the heavy phase liquid rate across the baffle can be adjusted by changing the volume of airflow. Hence, according to one advantage of the present invention, the system can be optimized to a desired output.

According to another advantage of the present invention, the air delivery system enters the machine through the back drive system. This increases the reliability of the air delivery system and allows for the addition of other value added components without interference from the air delivery system of the present invention.

According to further advantage of the present invention, short circuiting of the heavy phase discharge path is prevented. This is accomplished in the present invention by uniformly injecting air into the heavy phase material within the heavy phase material exit path.

According to a still further advantage of the present invention, a continuous process control is provided in real time. The continuous process control operates by measuring the properties of the heavy phase discharge stream with a sensor, and adjusting the continuous air supplied accordingly to vary to discharge rate of the heavy phase liquid in order to achieve a desired heavy phase liquid discharge consistency.

According to a still further advantage yet of the present invention, grit and other fine particles are expelled from a screw type centrifugal machine without using a beach. This is accomplished by the present invention by using turbulence inducers to at least partially re-suspend the grit within the heavy phase material discharge flow path.

According to a still further advantage yet of the present invention, abrasive damage to the machine and specifically at the discharge openings is reduced. This is accomplished in the present invention by eliminating the need for very small discharge openings and by discharging at a reduced bowl diameter.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
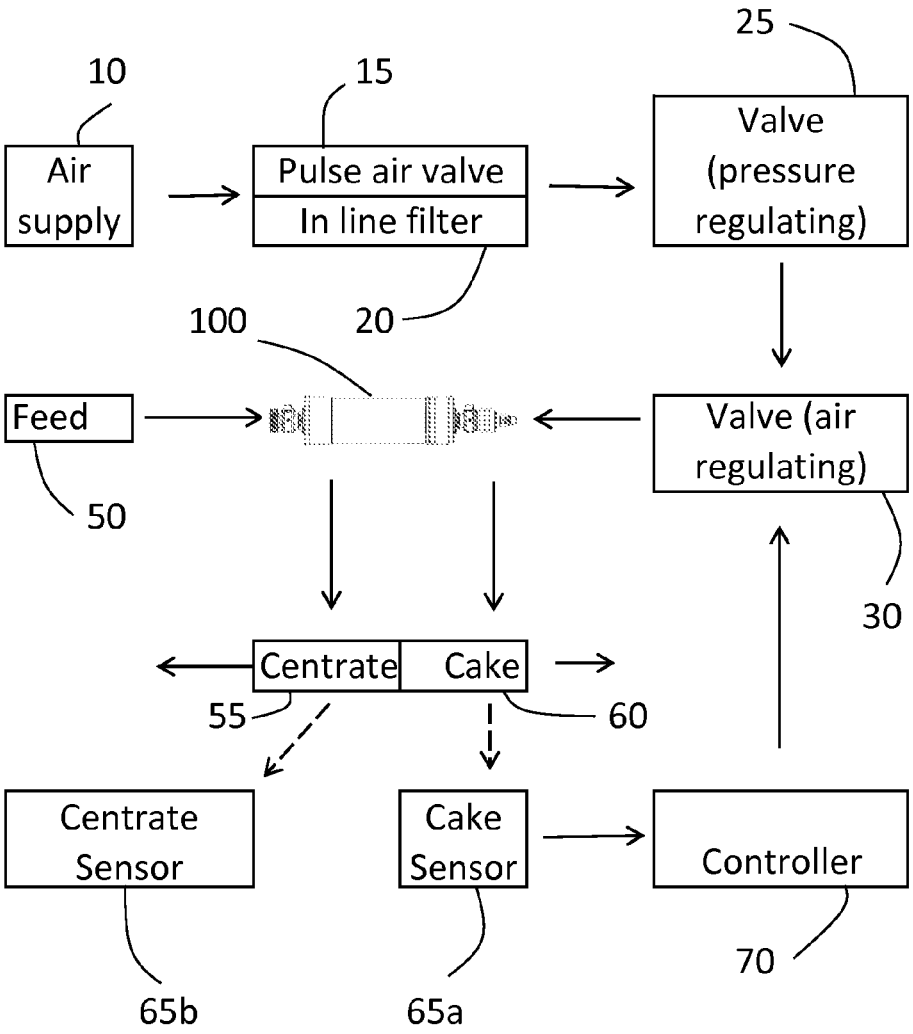
FIG. 1 is a schematic drawing showing preferred control components of the present invention.
Figure 2:
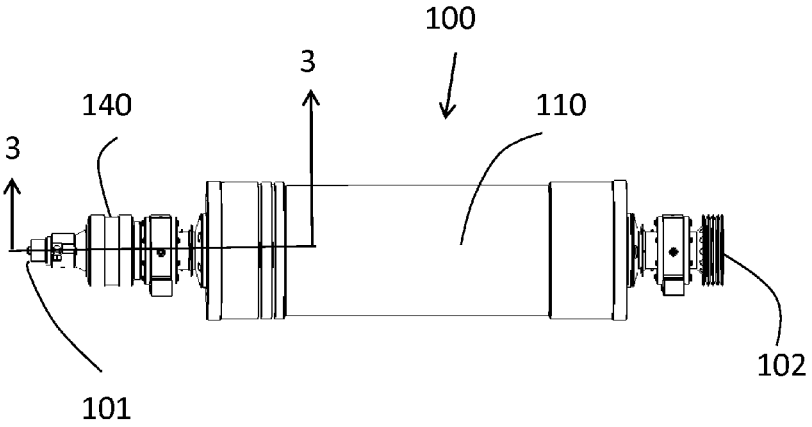
FIG. 2 is a side view of a preferred embodiment of the machine of the present invention.
Figure 3:
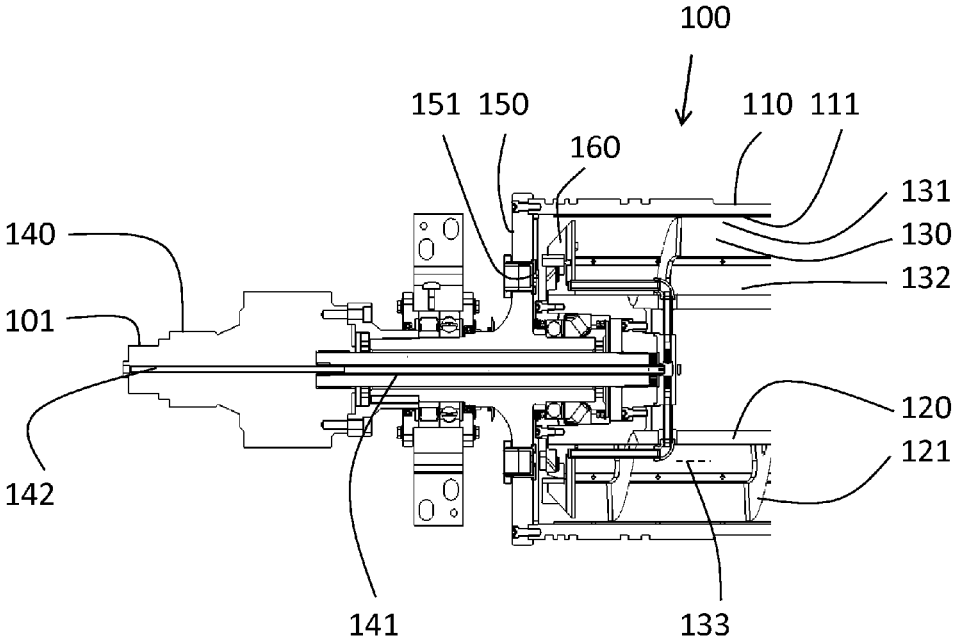
FIG. 3 is a partial cross-sectional view taken along line 3-3 in FIG. 2 showing the back drive assembly end of the machine.

Looking now at FIG. 1, it is seen schematically that several components interact with the machine 100, the operation of which achieves at least one of the advantages of the present invention. Compressed air can be supplied from an air supply 10. A pulse air valve 15 and filter 20 can be provided. A pressure regulator 25 and an air regulator 30 are further provided. Components 10, 15, 20, 25 and 30 form an external air delivery system. The pressure regulator 25 can regulate pressure between 5 and 500 psi, and preferably operates between 30 and 100 psi. The air regulator can supply between 1 and 50 SCFM, and preferably delivers between 2 and 10 SCFM. Liquid in need of processing or separation is supplied via a feed 50. The processed liquid exits the machine 100 as centrate 55 and cake 60. Sensors 65*a* (cake sensor) and 65*b* (centrate sensor), and a controller 70 are also provided. The cake sensor 65*a* can measure solids directly, for example, via a density meter, or indirectly, for example, via changes in the viscosity of the material. Centrate sensor 65*b* can measure, for example, the clarity of the water via a total suspended solids analyzer. It is appreciated that these sensors could alternatively measure other physical properties without departing from the broad aspects of the present invention. The operation of these components is described below.

Turning now to FIGS. 2-6, it is seen that a machine 100 is provided. The machine 100 has opposed ends 101 and 102. In practice end 101 is commonly referred to as the back drive end and end 102 is commonly called the feed end.

The machine 100 has an outer bowl 110. The outer bowl comprises a cylinder 111 with an internal cylinder wall that is annular. A conveyor 120 having flights 121 is also provided. The volume within the machine 100 between the cylinder 111 and the conveyor 120 defines a separation region 130 or pool. The separation region 130 has an outer diameter 131 adjacent the cylinder 111 of the outer bowl 110 and an inner diameter 132 adjacent the conveyor 120. The pool level 133 is defined as the depth of liquid within the separation region. In the preferred embodiment, the pool level is constant throughout the separation region.

A back drive system 140 is provided for maintaining a difference in rotational speed between the outer bowl 110 and the conveyor 120. The difference in rotational speed causes the flights 121 of the conveyor to undergo a mechanical sweeping action within the separation region 130 to force the heavy phase liquid towards a head wall 150, which has a heavy phase discharge opening 151 there through. Opening 151 is commonly referred to as the solids discharge weir. Air is preferably introduced into the machine along the axial center via an air entrance path 142 through a shaft 141 of the back drive system 140, and is routed to a distribution structure.

A solids baffle 160 is further provided according to the present invention. The solids baffle 160 is also a solids weir, but for sake of clarity, is referred to herein as a baffle. The solids baffle 160 extends radially away from machine central axis, and terminates a selected distance interior of the cylinder 111 of the outer bowl. The solids baffle 160 is spaced a selected distance inward from the head wall 150. Hence, looking specifically at FIG. 6, it is seen that a heavy phase flow path 170 extends from the separation region 130, between the solids baffle 160 and the cylinder 111 of the outer bowl, radially inward between the solids baffle 160 and the head wall 150, and out through the heavy phase discharge weir 151.

Figure 4:
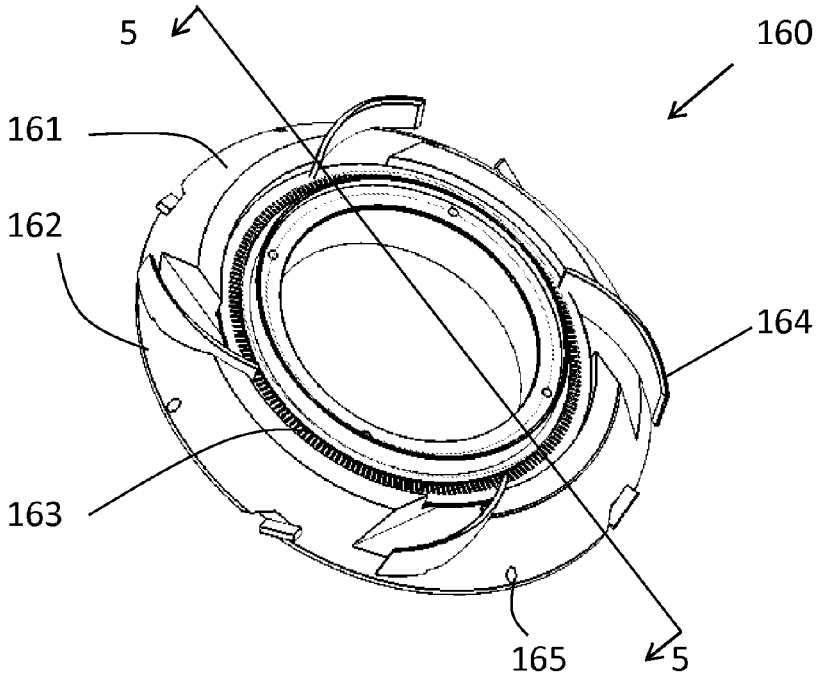
FIG. 4 is a perspective view of a preferred embodiment of a solids baffle of the present invention.
Figure 5:
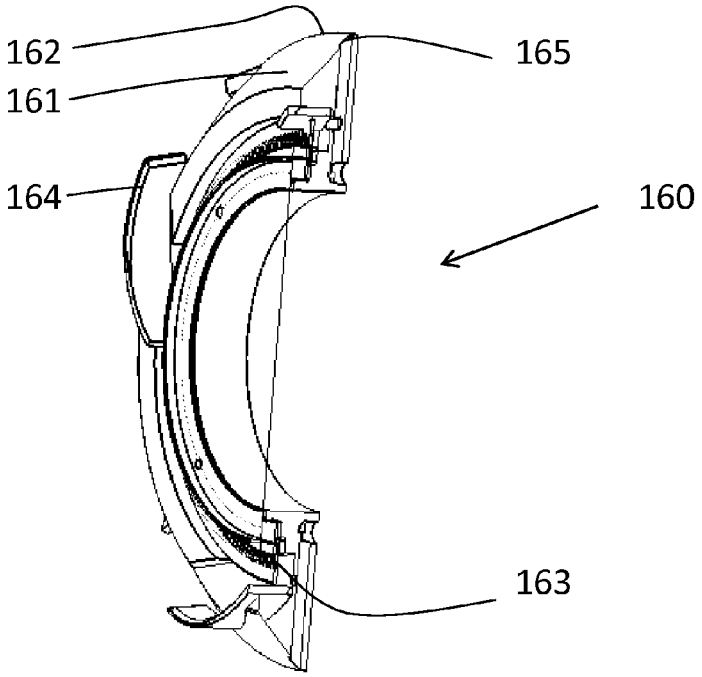
FIG. 5 is cross-sectional view taken along line 5-5 in FIG. 4.

A preferred embodiment of the solids baffle 160 of the present invention is best illustrated in FIGS. 4 and 5. Yet, it is appreciated that the design of the solids baffle can be changed without departing from the broad aspects of the present invention. The solids baffle 160 preferably has a tapered distal end 161 terminating at an outer perimeter 162. A plurality of radially spaced air injectors 163 are spaced on one side of the solids baffle 160. The air should be injected below the pool surface, preferably at a distance greater than 0.25 inch and more preferably greater than 0.5 inch below the pool surface. It is preferred that there is a uniform (or near uniform) radial injection of air above a minimum density to prevent short-circuiting of the heavy phase flow path 170. It is preferred that there are at least 16, 0.125 inch diameter evenly spaced holes at a common radius. However, increased effectiveness of the present invention can be achieved by using a greater number of holes. For example, a solids baffle 160 having 200 holes with 0.08" width thickness is illustrated. It is noteworthy that while equidistantly spaced slots are shown, that other opening shapes and spacing arrangements can be incorporated without departing from the broad aspects of the present invention. The solids baffle 160 is preferably located within approximately 2 inches from the head wall 150, and is more preferably within 0.5 inch of the head wall 150 in order to insure uniform distribution of air within the heavy phase flow path 170. Plows 164 can also be provided in the area of the radial injectors 163.

It is appreciated, that as described above, the solids baffle has parameters for depth, radial spacing and axial spacing. The combination of these three parameters allows the designers to customize the present invention for a variety of feed and heavy phase flow conditions.

Figure 6:
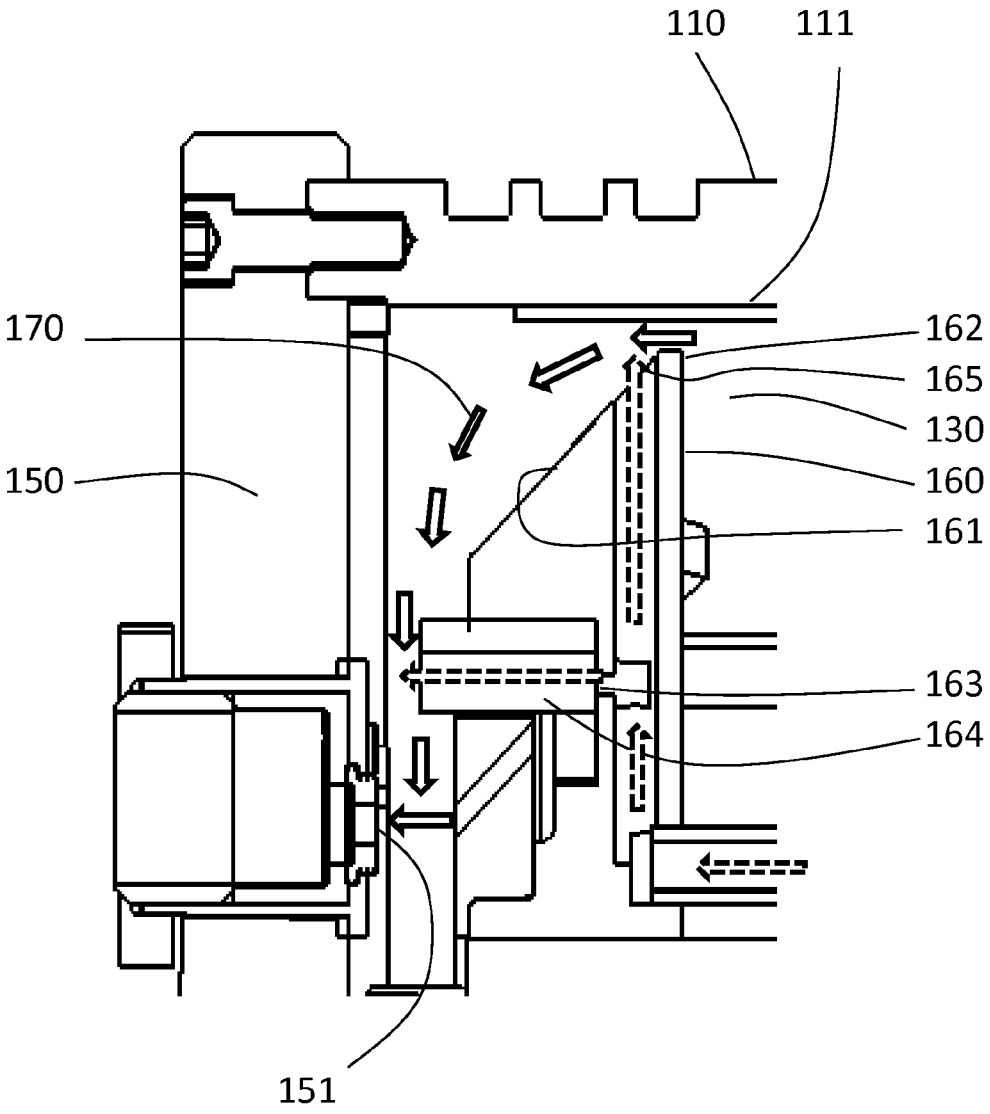
FIG. 6 is a close up cross-sectional view showing a preferred turbulence inducer and lift air injector of the present invention.

Turbulence inducers 165 are further provided, and are comprised of ports or openings located at or near the outer perimeter 162 of the solids baffle 160 for introducing air to cause turbulence. The turbulence inducers 165 promote particle transport of conveyed solids to a radial and inward discharge point by inducing localized turbulence and convective forces at a critical point along the conveyance pathway 170. Dense grit particles follow along the pushing face of the conveyer blade. The addition of air in and around the termination point of the conveyor induces turbulence into the heavy phase liquid as the air rises to the surface. The violent shift in a physical equilibrium has a strong radial and inward force component that is highly localized and thus mixes the grit in with previously segregated biomass while conveying both radial and inward to a discharge point. The turbulence inducers 165 and radially spaced air injectors 163 are shown in FIGS. 4-6 to be on the side of the solids baffle 160.

Turning now to the mass flow control of the present invention, the sensor 65*a* can measure the heavy phase flow cake discharge level. The controller 70 then makes a change in the air delivery system by adjusting the air flow rate up or down to maintain cake consistency or attain a discharge with desired characteristics. Thus, acting in real time by adjusting the air flow rate at the uniform air distribution point, a discharge with desired characteristics can be achieved.

Thus it is apparent that there has been provided, in accordance with the invention, a centrifugal liquid separation machine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A machine comprising:
an outer bowl without a beach;
a conveyor;
a separation region defined by said outer bowl and said conveyor;
a solids baffle with a first side and a second side, said first side being closer to a head wall;
a heavy phase flow path passing between said solids baffle and said outer bowl and exiting said machine through a discharge opening; and
a back drive maintaining a separate rotational velocity between said outer bowl and said conveyor, wherein the separate rotational velocity provides a sweeping action between said outer bowl and said conveyor, and an air delivery path via said back drive, said air delivery path delivering an amount of air adjacent said solids baffle on said first side of said solids baffle to resuspend an amount of settled items into said heavy phase flow path.

2. The machine of claim 1 wherein said back drive has a back drive central axis and said air delivery path is along said back drive central axis.

3. The machine of claim 1 wherein said air delivery path passes through said solids baffle.

4. The machine of claim 3 wherein:
said solids baffle has an outer perimeter; and
said air delivery path exits said solids baffle through at least one turbulence inducer near said outer perimeter.

5. The machine of claim 4 wherein:
said solids baffle has a tapered end terminating in said outside perimeter; and
said at least one turbulence inducer passes through said tapered end.

6. The machine of claim 3 wherein:
said machine further comprises a head wall, said heavy phase flow path further passing between said head wall and said solids baffle;
said separation region has a pool surface; and
said solids baffle has a plurality of air injectors that inject said amount of air below said pool surface to inject air into said heavy phase flow path.

7. The machine of claim 6 wherein said air injectors inject said amount of air at least 0.25 inches below said pool surface.

8. The machine of claim 7 wherein said air injectors inject said amount of air at least 0.50 inches below said pool surface.

9. The machine of claim 6 wherein there are at least 16 radially spaced air injectors providing a uniform driving force to said heavy phase flow path.

10. The machine of claim 9 wherein there are 200 slot shaped air injectors, each having a width of 0.08 inches.

11. The machine of claim 6 wherein:
said head wall has a heavy phase discharge opening there through; and
said solids baffle is located within 0.5 inch of said head wall.

12. The machine of claim 1 wherein said air delivery path is a continuous feed air delivery path.

13. The machine of claim 12 wherein said amount of air is delivered at between 30 and 100 psi via said air delivery path.

14. The machine of claim 12 wherein between 2 and 10 SCFM are delivered via said air delivery path.

15. A machine comprising:
an outer bowl without a beach;
a conveyor;
a separation region defined by said outer bowl and said conveyor;
a solids baffle having a first side and a second side, said first side being closer to a head wall,
said head wall with a heavy phase discharge opening there through;
a heavy phase flow path passing first between said solids baffle and said outer bowl and then between said solids baffle and said head wall;
a back drive maintaining a separate rotational velocity between said outer bowl and said conveyor, wherein the separate rotational velocity provides a sweeping action between said outer bowl and said conveyor; and an air delivery path continuously delivering an amount of air to said first side of said solids baffle and into said heavy phase flow path.

16. The machine of claim 15 wherein:

said solids baffle has an outer perimeter; and said air delivery path exits said solids baffle through at least one turbulence inducer near said outer perimeter and resuspends an amount of settled items into said heavy phase flow path.

17. The machine of claim 15 wherein:

said separation region has a pool surface; and said solids baffle has at least 16 radially spaced air injectors that inject said amount of air at least 0.25 inches below said pool surface to inject air into the heavy phase flow path providing a uniform driving force to said heavy phase flow path.

18. A machine comprising:

an outer bowl without a beach;

a conveyor;

a separation region defined by said outer bowl and said conveyor;

a solids baffle having a first side and a second side, said first side being closer to a head wall, said head wall with a heavy phase discharge opening there through;

a heavy phase flow path passing first between said solids baffle and said outer bowl and then between said solids baffle and said head wall;

a back drive maintaining a separate rotational velocity between said outer bowl and said conveyor, wherein the separate rotational velocity provides a sweeping action between said outer bowl and said conveyor;

a sensor measuring a characteristic of said heavy phase flow path;

an air delivery path delivering a variable amount of air to said first side of said solids baffle and into said heavy phase flow path; and a controller for varying said variable amount of air in response to said characteristic measured by said sensor.

19. The machine of claim 18 wherein said variable amount of air in the range of 30 to 100 psi and from 2 to 10 SCFM is delivered via said air delivery path.

20. The machine of claim 18 wherein said sensor measures one of:

a density of said heavy phase flow path; and changes in viscosity of said heavy phase flow path.

* * * * *